United States Patent [19]

Hajek

[11] 4,419,774

[45] Dec. 13, 1983

[54] DISPOSABLE SHAMPOO BASIN

[76] Inventor: Rosemary T. Hajek, 615 Shamrock Rd., Bel Air, Md. 21014

[21] Appl. No.: 451,399

[22] Filed: Dec. 20, 1982

[51] Int. Cl.[3] ..... A54D 19/08; A54D 19/10

[52] U.S. Cl. ..... 4/516; 4/515; 4/520; 4/516

[58] Field of Search ..... 4/515–523; 128/DIG. 13

[56] References Cited

U.S. PATENT DOCUMENTS

| | | | |
|---|---|---|---|
| 2,455,607 | 12/1948 | Price | 4/515 |
| 2,475,259 | 7/1949 | Singleton | 4/159 |
| 2,514,584 | 7/1950 | Muth | 4/515 |
| 2,600,557 | 6/1952 | Marriott | 4/521 |
| 2,658,512 | 11/1953 | Icheong | 128/292 |
| 2,803,834 | 8/1957 | McClung | 4/522 |
| 3,465,370 | 9/1969 | Chernick | 4/515 |
| 3,733,620 | 5/1973 | Glintz | 4/515 |
| 3,816,858 | 6/1974 | Martin | 4/515 |
| 3,854,148 | 12/1974 | La Rose | 4/519 |

*Primary Examiner*—Henry K. Artis

*Attorney, Agent, or Firm*—John F. McClellan, Sr.

[57] ABSTRACT

A system for use in shampooing the hair and scalp of bed patients provides in a completely biodegradable diposable plastic basin a circular bottom with ringed wall upstanding around it and having at the patient-neck location a first bag sealed along a low wall portion and up the sides thereof, and containing an easily insertable second bag which in turn contains polystyrene granules and which can be adjusted within the first bag to form a water-tight fit around the underside and sides of the patient's neck without sliding friction with the skin of the patient; the second bag can be supplied with any desired quantity of granules necessary to fit a particular patient; a roll-up flat tube of plastic is supplied at one or both sides for draining the basin.

12 Claims, 5 Drawing Figures

DISPOSABLE SHAMPOO BASIN

FIELD OF THE INVENTION

This invention relates generally to containers and specifically to a disposable shampoo basin for use in bed patient care.

BACKGROUND OF THE INVENTION

From a psychological point of view a bed patient who is well groomed and clean feels better. Frequently, bed patients must go for a week or more without shampoos, because of the difficulty of giving them quick, pleasant, efficient shampoos, without wetting or messing bed linens and gowns. Adding to the expense and time and effort required is the necessity also of using extra towels to mop up spillage and splashes around the head of the patient.

Aggravated problems of this nature occur when caring for patients fixed in "Halo Vests", metal framework immobilizing the head through anchorage to the body. Sanitary shampoos are prescribed to inhibit infection at the points of affixation to the head; often these are bolt-like metal fixtures screwed through the skin into the bone of the head and left there from three to six months. During the first four to six weeks or more the patient may lack equilibrium, and head and scalp cleaning, particularly including the areas at bolt-like fixtures, must be done in bed, carefully and frequently, to prevent infections, and to prevent damage to hair follicles.

Shampooing the "Halo" patient is especially messy in another way—the shampoo that should be used is an iodine-base compound (example: "Bedidine") that stains bed linens, gowns, and towels.

Other types of hair and scalp problems occur with bed patients. Since the banning of DDT, head lice have become nearly epidemic. It is necessary to go through a repeated-treatment procedure to get rid of these.

With all these problems, patient safety and sanitation are of utmost importance.

PRIOR ART

In the prior art, several disclosures relate proposed solutions for the above problems, the following U.S. patents being known:

No. 2,475,259 issued to W. C. Singleton on July 5, 1949, disclosed a bed-patient washing tray of hard rubber or the like, with a cushioned recess for the neck, and a drain;

No. 2,658,512 issued to J. D. Tcheong on Oct. 10, 1953 disclosed an inflatable-rim "C"-shaped washing basin with drapes and drain;

No. 3,465,370 issued to M. W. Chernick on Sept. 9, 1969 disclosed a hair washing tray for bed patients evidently made like a "blister pack" of vacuum-formed plastic so that it could be discarded; the rim had a recess for a neck and an adjacent sloped support.

No. 3,733,620 issued to G. E. Glintz on May 22, 1973 disclosed a foam plastic-drain-equipped tray and pad with throwaway plastic sheet liner;

No. 3,816,858 issued to M. Martin on June 18, 1974 disclosed an inflatable-ring hair washing basin with circular drain leading to a discharge, and levelling tubes.

SUMMARY OF THE INVENTION

Whether variously because of expense, difficulty of use, danger to patients, discomfort or lack of sanitation, none of the above disclosed basins has become the standard medical article the purposes indicated, and to supply a system which will become such is a principal object of this invention.

Further objects are to provide a system as described which:

is safe and stable in use, free of danger of shifting as by sudden deflation, and securely and easily molded to fit any neck/head/shoulder shape for head support without necessity for scrubbing basin material along the patient's skin;

is thin and flattenable in wall contour for ease in insertion beneath a patient's head, and with completely flexible walls providing easy access all around the patient's head, while cutting down on the mess of in-bed shampooing;

is splash and spill resistant, with flexible upright walls which inhibit rising of the head-up-bed end of the system, and with drain to either side permitting emptying when and where desired;

is sanitary and completely disposable and biodegradable to avoid possibility of future infection or infestation, which requires no inflator or other parts and is altogether biodegradable when discarded;

is compact in storage; easy, quick and simple to deploy and to use, and odor-free;

is psychologically beneficial to female patients while in use through providing an attractive halo appearance of simple circular outline accentuating appearance.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
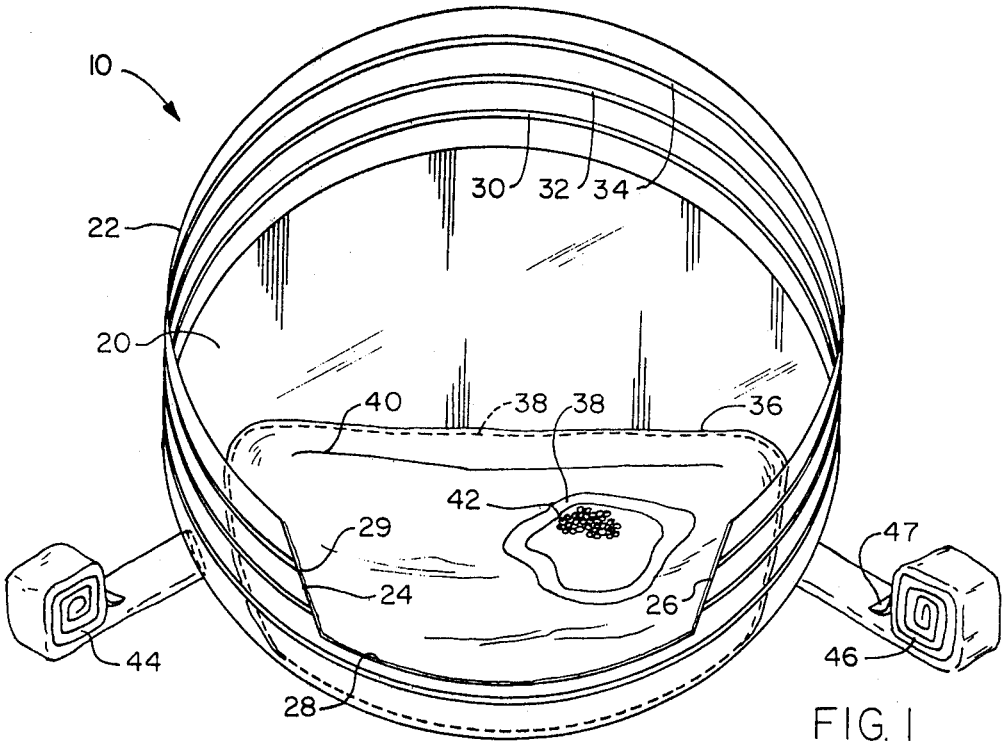
FIG. 1 is a perspective view partially broken away of the invention deployed for use.

FIG. 1 shows the system of this invention in embodiment 10 as a unitary basin assembly ready for use. The circular base 20 is of a single thickness of flexible thermoplastic sheet such as 3 mil (0.07 mm) polyethylene sheet, and about 18 inches (45 cm) to 20 inches (50 cm) in diameter. Integral with the base is a circular upright flexible wall 22 of the same material. The wall height preferably is four inches (10 cm) except at the near end or neck end where the wall slopes down at 45° on either side 24, 26 to a center portion 28, 1 inch (2.5 cm) high and 6 inches (15 cm) long.

Preferably the wall is reinforced by a plurality (preferably at least 3) of integral coaxial flexible ribs 30, 32, 34 of the same material, along at least a part of the wall around said base, each being $\frac{1}{4}$ inch (6 mm) high by 1/16 inch (1.5 mm) thick. The lowest rib 30 may be $\frac{3}{4}$ inch (18 mm) up from the base and the other two at 1 inch (2.5 cm) spacings on-center. The center portion 28 may have the lowest rib 30 passing along it.

A first bag 36 cemented or otherwise continuously attached or sealed as at 29 along the center portion 28 and the sloping sides 24, 26 completes a watertight rim, which includes the upright sides, around the base. The first bag may be of the same sheet material as the bottom and sides.

Within the first bag 36 is a second bag 38, inserted through an overlapping-side slot structure 40 in the first bag.

The second bag contains a selectable quantity of granules 42 of soft particulate matter such as soft polystyrene foam, 1/16 inch (1.5 mm) to ⅛ inch (3 mm) in diameter, sealed within it, and is means for supportively sealing at a patient's neck/head/shoulder area by contouring said first bag for water-tight, bracing fit at a patient's neck.

As an example of quantity, the second bag may be adjustably filled to a diameter of perhaps 5 inches (13 cm) 10 inches (26 cm) long, or about 80% of capacity for comfortable, soft-but-tight water sealing around the neck back and sides of an average-size adult user. The seal may be fully as high as the walls, if desired, because of the proportions. The second bag is proportioned for being freely moved with the first bag.

A roll-up flat tube plastic drain 44, 46 cemented or otherwise attached at each side adjacent the first bag 36, vents the basin when the shampooing is done, to the side of the patient's bed where the washstand is, in the hospital room. Only one of these plastic drains need by supplied if beds are to be swung around, if necessary, to give drain access to the washstand, but two are preferable. They may be sealed against leakage by a piece of polyethylene tape 47 for holding them in rolled-up, folded configuration until used.

Figure 2:
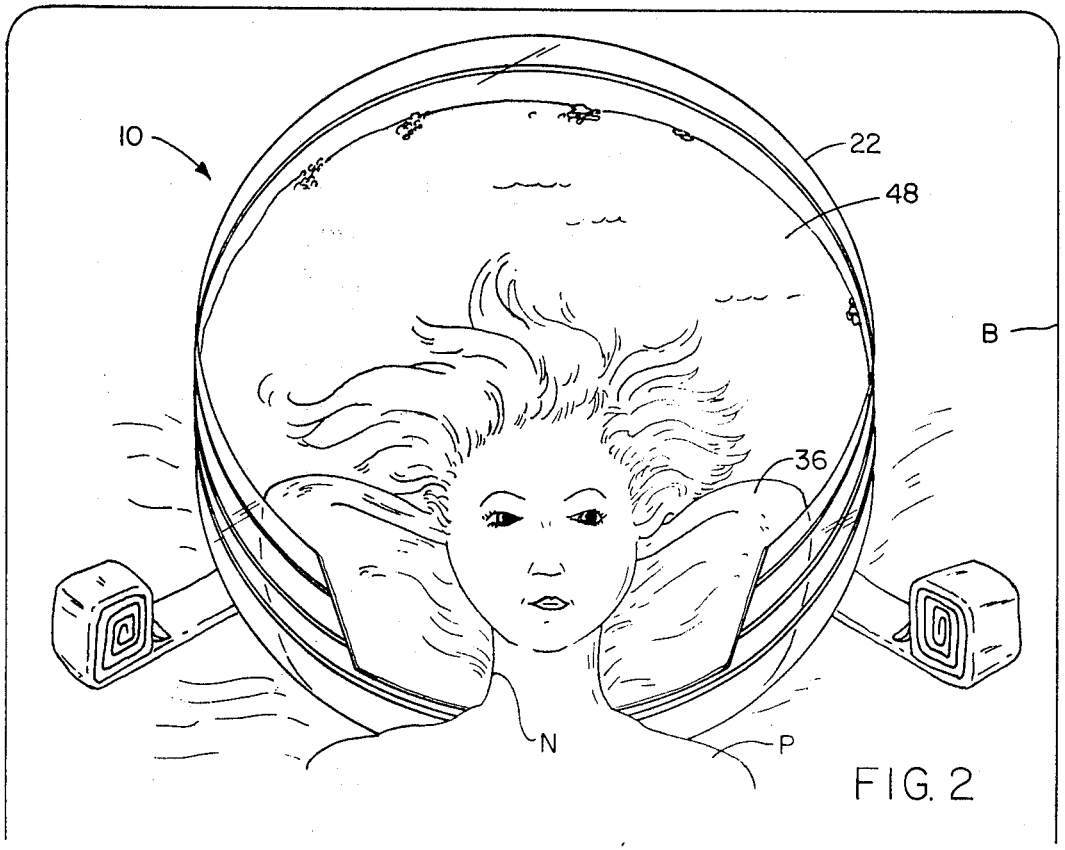
FIG. 2 is a similar view of the invention in use.

FIG. 2 shows the invention 10 in use position for shampooing the hair and scalp of a patient P on a bed B. The wall 22 is completely flexible and yet when not pressed down flexibly stands upright, containing the washing solution 48 but preventing splashes from wetting the bed. It can be bent to any suitable shape and still function. The patient's head is comfortably but firmly fitted by the polystyrene foam-containing bag structure 36 which seals closely around the back of the patient's neck N. Because the central portion of the wall is low with neck-clearing sloped sides, and the bags are soft, the patient's head, neck and shoulders are advantageously free of pressure by hard or sharp structures.

Patient comfort is assured during adjusting of the bag structure because the outer bag needs little or no shifting, the inner bag sliding smoothly within it during the adjusting. Sliding friction between the outer bag and the neck of the patient is largely avoidable by this means.

Figure 3:
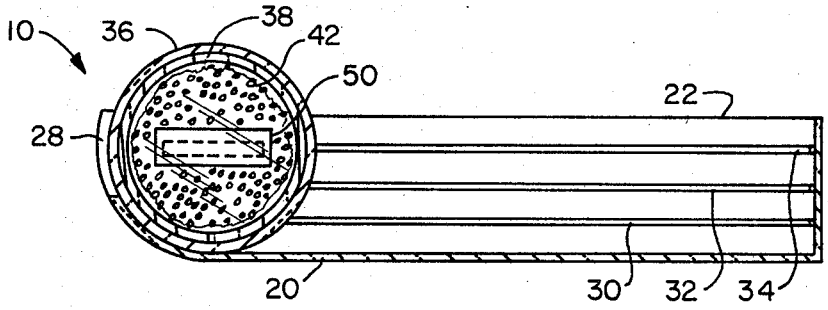
FIG. 3 is a side elevational diagram in partial section, with sizes exaggerated for exposition.

FIG. 3 shows a partially sectional diagram the invention 10 with wall 22, rings 30, 32, 34 around the wall, central portion 28 of the wall, first or outer bag 36, second or inner bag 38, and tape 50 sealing the end of the inner bag closed to keep the polystyrene foam granules 42 inside it.

Figure 4:
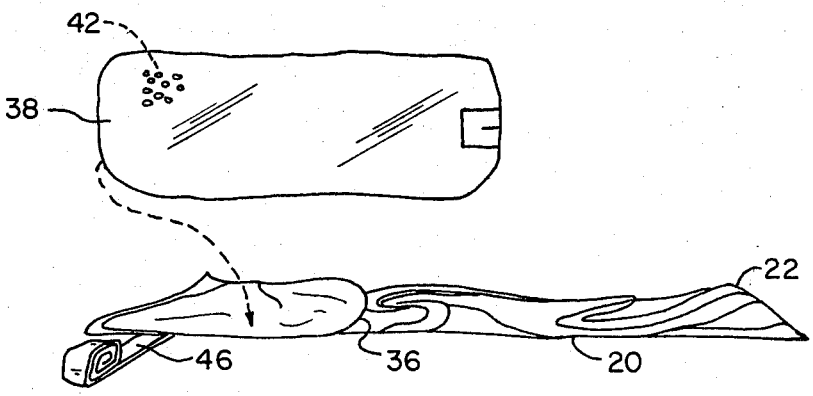
FIG. 4 is a perspective view of an assembly stage.

FIG. 4 shows in partially exploded diagram the base 20, wall 22, outer bag 36 and a drain 46, comprising the portion of the invention being unfolded so that the inner bag 38 in which a quantity of polystyrene foam granules 42 has already been put, in readiness for insertion (arrow) into the outer bag. For compact storage and for individual fitting, the foam particles may be kept in a large box or drum until needed.

Use of the inner bag not only makes for convenience in storage and filling but also, as noted above and most importantly, permits easy sliding for fitting around a patient's neck and head and shoulder area to form and wedge it in place, without scrubbing plastic along the patient's skin. The outer bag shifts almost not at all while the inner bag is being positioned and shaped. As an alternative, the outer bag alone may be used, filled with the granules or foam particles. Further, the inner bag is protected by the outer bag and may be re-used, if desired.

Figure 5:
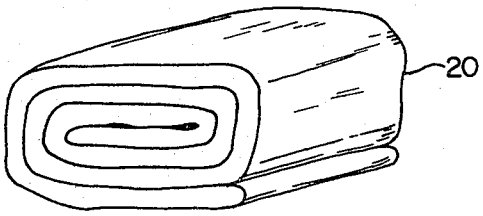
FIG. 5 is a perspective view of a storage mode.

FIG. 5 shows the invention less the plastic foam granules; the base primarily appearing compactly folded prior to deployment and use.

It will be appreciated that the polyethylene and polystyrene foam and polyethylene plastic tape used comprise the entirety of the materials, and that all are biodegradable.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system for use in washing the hair of a patient on a bed and having a base, a wall around the base and means including a quantity of soft particulate matter for supportively sealing at a patient's head/neck/shoulder area, the improvement comprising: the means for supportively sealing including a part of said wall and a bag, and means in said bag for adjustably contouring said bag for water-tight fit to a patient's neck.

2. In a system as recited in claim 1, said wall being substantially upright and flexible, and a plurality of flexible reinforcing ribs along at least a part of said wall around said base.

3. In a system as recited in claim 2, said base and said wall being of a single thickness of plastic sheet.

4. In a system as recited in claim 1, the means in said first bag for adjustably contouring said bag including a second bag within the first said bag and containing said quantity of soft particulate matter, and said second bag proportioned to be freely movable within the first said bag.

5. In a system as recited in claim 4, the first said bag and said second bag being of plastic sheet.

6. In a system as recited in claim 5, means for adjusting the quantity of soft particulate matter in said second bag, comprising said second bag having a filler opening therein, and means for closing said filler opening.

7. In a system as recited in claim 4, means for insertion of said second bag into the first said bag, comprising the first said bag having overlapping sides at an opening therein.

8. In a system as recited in claim 4, said part of the wall including a low center portion proportioned for clearing a patient's neck, with the first said bag sealed along the low center portion.

9. In a system as recited in claim 8, said low center portion having sloping sides for clearing a patient's neck, and said wall having a plurality of flexible reinforcing ribs.

10. In a system as recited in claim 9, said low center portion having a single one of said flexible reinforcing ribs therealong.

11. In a system as recited in claim 4, a roll-up flat tubing drain attached to said base adjacent at least one side of the first said bag.

12. In a system as recited in claim 11, a said roll-up flat tubing drain, attached to said base adjacent each side of the first said bag.

* * * * *